US007155876B2

(12) United States Patent
VanderTuin et al.

(10) Patent No.: US 7,155,876 B2
(45) Date of Patent: Jan. 2, 2007

(54) HEAT TUNNEL FOR FILM SHRINKING

(75) Inventors: Bradley Jon VanderTuin, Alexandria, MN (US); Richard Jerome Schoeneck, Alexandria, MN (US); Irvan Leo Pazdernik, Alexandria, MN (US); Bruce Malcolm Peterson, Alexandria, MN (US); Paul Howard Wagner, Alexandria, MN (US)

(73) Assignee: Douglas Machine, Inc., Alexandria, MN (US)

( * ) Notice: Subject to any disclaimer, the term of this patent is extended or adjusted under 35 U.S.C. 154(b) by 0 days.

(21) Appl. No.: 10/680,538

(22) Filed: Oct. 7, 2003

(65) Prior Publication Data

US 2004/0231301 A1 Nov. 25, 2004

Related U.S. Application Data

(60) Provisional application No. 60/473,372, filed on May 23, 2003.

(51) Int. Cl.
*B65B 53/06* (2006.01)

(52) U.S. Cl. ..... 53/48.2; 53/201; 53/557; 34/216

(58) Field of Classification Search ..... 53/48.2, 53/201, 557; 34/212, 216
See application file for complete search history.

(56) References Cited

U.S. PATENT DOCUMENTS

| | | | | | |
|---|---|---|---|---|---|
| 3,222,800 | A | * | 12/1965 | Siegel et al. | 34/212 |
| 3,349,502 | A | * | 10/1967 | Kiefer | 34/216 |
| 3,545,165 | A | | 12/1970 | Greenwell | |
| 3,721,804 | A | * | 3/1973 | Feldman | 53/557 |
| 3,830,036 | A | * | 8/1974 | Harkness et al. | 53/557 |
| 3,866,331 | A | * | 2/1975 | Evans, Jr. | 34/216 |
| 3,897,671 | A | * | 8/1975 | Higgins | 53/557 |
| 5,050,368 | A | * | 9/1991 | Noh | 53/557 |
| 5,765,336 | A | * | 6/1998 | Neagle et al. | 53/201 |
| 5,771,662 | A | | 6/1998 | Struges et al. | |
| D481,049 | S | | 10/2003 | Limousin | |
| 6,648,634 | B1 | * | 11/2003 | Nava | 53/557 |
| 6,689,180 | B1 | * | 2/2004 | Liao | 53/557 |
| 2004/0123566 | A1 | | 7/2004 | Limousin | |

* cited by examiner

*Primary Examiner*—John Sipos
(74) *Attorney, Agent, or Firm*—Nikolai & Mersereau, P.A.

(57) ABSTRACT

A heat tunnel for applying heated air to articles enclosed in shrink-wrap film includes at least one air supply unit; a conveyor; and a heat shroud spaced from the conveyor. Tha air supply unit includes a source of heated air, a fan, a heated air plenum, air ducts, and a return air plenum. Multiple air supply units can be provided along the conveyor to create a heat tunnel of desired length.

21 Claims, 21 Drawing Sheets

HEAT TUNNEL FOR FILM SHRINKING

CROSS REFERENCE

This application claims the benefit of co-pending U.S. patent application Ser. No. 60/473,372, filed May 23, 2003.

BACKGROUND OF THE INVENTION

The present invention is directed to an apparatus for packaging articles using shrink-wrap film and, particularly, to an improved heat tunnel that can be used for various film configurations.

It is known in the art to overwrap articles in a web of heat shrinkable film to form a multipack package by separating a tube of such film wrapped around spaced groups of articles along a weakened zone by shrinking the tube adjacent the zone and then by shrinking the tube section formed thereby around the articles to form a package. See U.S. Pat. No. 3,545,165.

Previous methods of packaging such as the above have involved feeding the groups of articles into a heat tunnel in series, with the film wrapped around the articles from the leading edge of the group to the trailing edge of the group. FIG. 1 shows how this is typically accomplished. Groups G of articles A are placed spaced apart on a conveyor C. A layer L of film F (usually from a roll of film) is wrapped around the groups G with the film layer L continuously covering adjacent groups G.

The groups G are then fed on the conveyor into a heat tunnel T. Heat and (typically) forced air is applied to the junction J between adjacent groups G, causing the film layer L to soften at the junction J and pinch off between the groups G, at the same time shrinking tightly against the groups G as shown. This results in complete packages P of articles A, with the film shrunk about them. The closed ends E of the packages P (known as "bulls eyes") are at ends of the packages P in the direction of travel of the conveyor C (shown by the arrow).

An extension to the above apparatus is shown in FIG. 2. Here, parallel conveyors C1, C2, C3, etc. carry article groups G1, G2, G3, etc. into the heat tunnel T, where the above-described heat-shrinking occurs. The parallelism improves total throughput.

The apparatus shown in FIGS. 1 and 2 has a number of disadvantages. In gathering of multiple articles A into the groups G (known as "pack patterns"), the continuous tube of film F creates design challenges to support the groups G from the underside while the tube of film F is formed around the product. This is further complicated by product size changeover requirements. Theoretically, the conveyor C that transports the product pack pattern into the heat tunnel T would have to change widths for each change in product size to accommodate the tube of film F around the pack pattern.

In yet another variation (which the Assignee has used in the past), cut sleeves of film F are used, one sleeve per article group, instead of a continuous layer of film F around the groups G1, G2, G3, etc. However, the groups G are fed serially into the heat tunnel T with the articles A in each group G oriented in such a manner that the film F will be shrunk around each group G with the resulting closed ends E ("bulls eyes") oriented transverse to the direction of travel of the conveyor C. To improve throughput, multiple parallel streams of articles A may be fed into the heat tunnel T.

The present application discloses an improved heat tunnel for use with both pre-perforated and non-perforated shrink wrap film.

In the packaging industry, aesthetics has become an increasingly important issue, both for the package that is produced and the machine that produces it. When the film is shrunk around the end of a package, it should leave a circular opening, the "bulls eye", and should be free of wrinkles. This should be consistent from package to package and over a variety of product sizes.

Many of the challenges in producing aesthetically pleasing "bulls eyes" stem from the way that current heat tunnels operate. Current heat tunnels often produce deformed bulls eyes due to uncontrolled airflow. That is, as the group of articles enclosed in shrink-wrap film enters the heat tunnel, the film is subjected to various disruptive air currents, causing the film to flutter as it is shrunk. This uncontrolled airflow results in the film wrinkling and shrinking non-uniformly, which in turn results in unaesthetically pleasing bulls eyes. Furthermore, current heat tunnels are not generally adjustable for various product sizes.

There is a need for a new heat tunnel capable of producing consistently good bulls eyes with controlled shrink and that is adjustable for a range of product sizes.

There is also a need for a new heat tunnel to reduce the heat transfer to the outer skin of the heat tunnel, increasing the operating efficiency and improving the working environment around the machine by lowering the temperature.

There is also a need for a more aesthetically appearing heat tunnel and one of reduced size.

All of the above needs are addressed by the present invention.

SUMMARY OF THE INVENTION

A heat tunnel for applying heated air to articles to enclose the articles in shrink-wrap film, the heat tunnel includes:

(a) at least one air supply unit, the air supply unit further comprising a source of heated air, a fan, a heated air plenum, air ducts, and a return air plenum;

(b) a conveyor; and (c) a heat shroud spaced from the conveyor, wherein multiple air supply units can be provided along the conveyor to create a heat tunnel of desired length.

A principal object and advantage of the present invention is that a heat tunnel according to a preferred form provides a balanced laminar flow of air through the conveyor and controlled airflow from the sides. This creates shrink film covered packages with consistently shaped bulls eyes, a minimum distortion of graphics, and a minimum of wrinkles.

Another principal object and advantage of the present invention is that a heat tunnel according to a preferred form permits vertical adjustment of the heat shroud to ensure consistent results over a range of product sizes.

Another principal object and advantage of the invention is that the heated air passing through the conveyor contacts the film under the product and results in an "air weld" of the film lap seam.

Another principal object and advantage of the invention is that the heated air has a minimum contact with the product conveyor, so that the conveyor can be maintained at a relatively cool temperature of about 220° F. As a result, the film does not stick to the conveyor and less heat energy is lost to the environment.

Another principal object and advantage of the present invention is that the outer surface of the heat tunnel stays cooler during operation, thus making the heat tunnel safer and more comfortable to work around and also increasing operating efficiency due to the reduced heat loss.

Another principal object and advantage of the present invention is improved appearance, with a curved heat shroud and a lower profile.

Another principal object and advantage of the present invention is that the conveyor is adjustable to use either side-by-side cut tubes of articles or articles enclosed in pre-perforated shrink wrap film.

Another principal object and advantage of the present invention is that a heat tunnel according to a preferred form can be used with a single chain conveyor the full width of the machine or with multiple chains running side by side with center air ducts.

Another principal object and advantage of the present invention is that the conveyor construction allows air from the heated air plenum to freely pass through it to the product.

Another principal object and advantage of the present invention is that the conveyor temperature is controlled by a cooling fan that circulates air across the full width of the conveyor.

Another principal object and advantage of the present invention is that a heat tunnel according to a preferred form produces a sound reduction of approximately 13% compared to previous models.

Another principal object and advantage of the present invention is that the OEM rated service life of the heaters is in excess of 20,000 hours of operation.

Another principal object and advantage of the present invention is that a heat tunnel according to a preferred form provides modular air supply units having a source of heated air, a fan, a heated air plenum, air ducts, and a return air plenum, so that the modular air supply units may be arranged in series with a separate conveyor and heat shroud to produce a heat tunnel of variable length, so that the length of the heat tunnel may be adjusted to correspond to the speed of incoming articles, providing sufficient time for the articles to reach the shrinking temperature of the shrink wrap film and for the shrink-wrap film to shrink around the articles.

DETAILED DESCRIPTION OF THE PREFERRED EMBODIMENT

In one aspect, the present invention is an apparatus 10 for applying heat to articles A and to enclose the articles A in shrink-wrap film F.

The apparatus 10 (FIGS. 4, 5, and 6) comprises a conveyor 12 having a plurality of first apertures 14 therethrough. A motor 16 drives the conveyor 12 in a first direction as shown by the arrows in FIG. 5.

Figure 7:
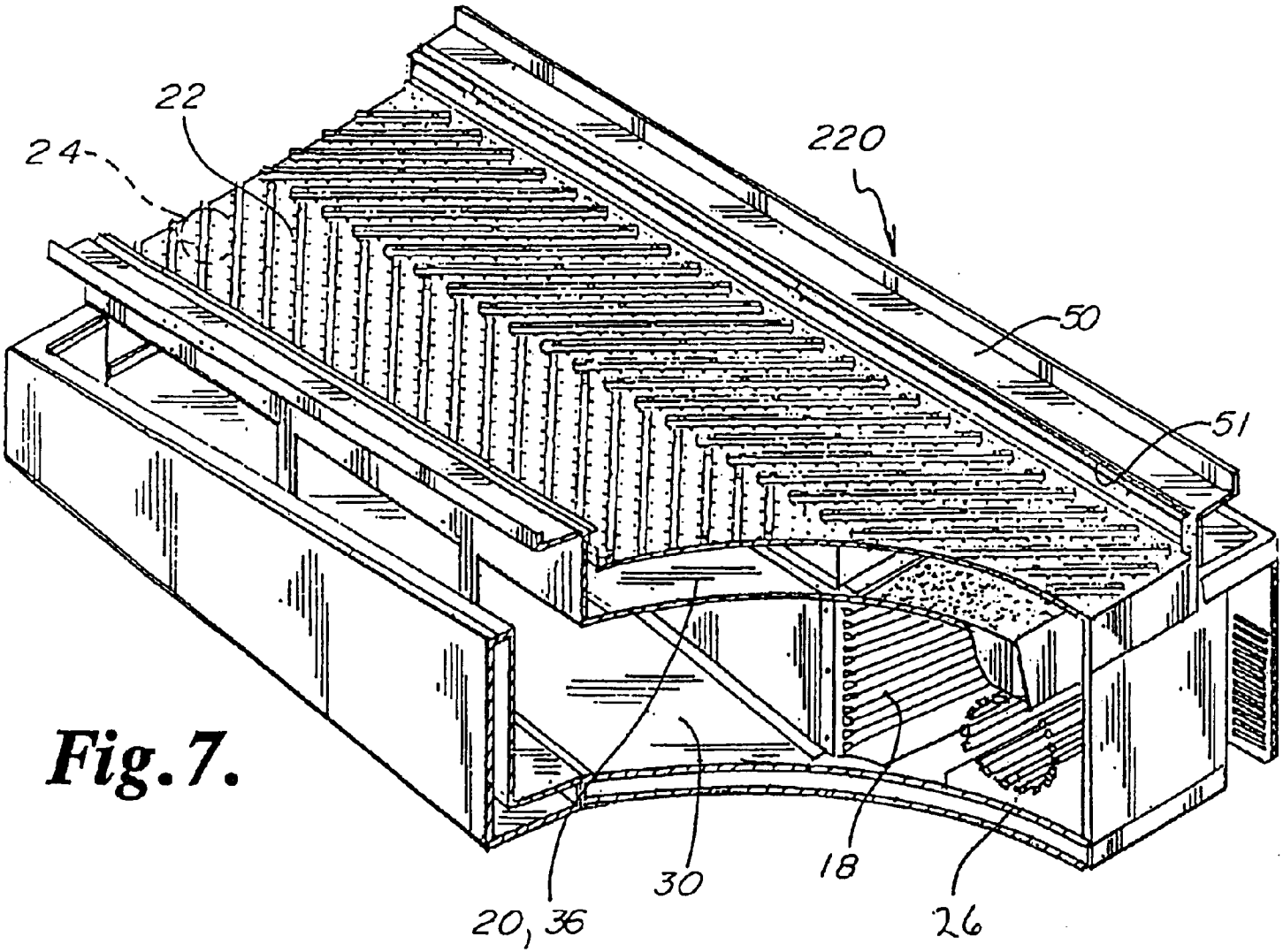
FIG. 7 is a perspective view of an air supply unit of the present invention.

The apparatus 10 further comprises a source of heated air 18. The apparatus 10 further comprises (FIG. 7) a heated air plenum 20 under the conveyor 12 and supporting the conveyor 12, the plenum 20 having a top surface 22 having a plurality of second apertures 24 therethrough. It has been found that an optimal size for the second apertures 24 is about 7⁄16 inch to 7⁄32 inch . In this range, the flow of heated air through the apertures 24 is much less turbulent than with either larger or smaller aperture sizes. Specifically, this range of aperture size creates primarily a vertical air flow, while larger aperture sizes allow horizontal flow.

Figure 8:
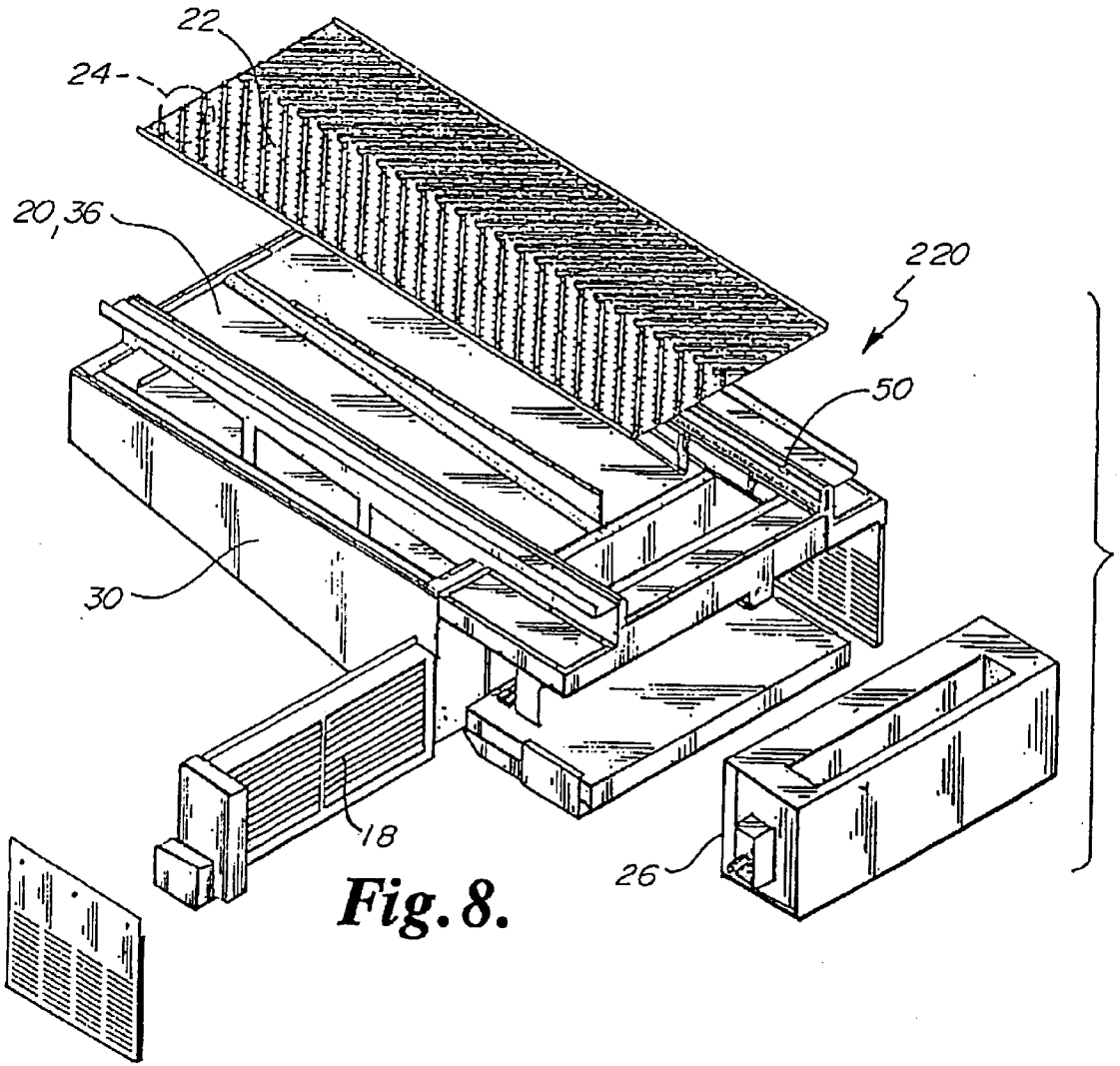
FIG. 8 is an exploded perspective view of an air supply unit of the present invention.

The apparatus 10 further comprises (FIG. 8) a fan 26 blowing heated air from the source of heated air 18 through the heated air plenum 20, through the second apertures 24, and through the first apertures 14.

The apparatus 10 further comprises a return air plenum 30 returning air to the source of heated air 18.

Figure 14:
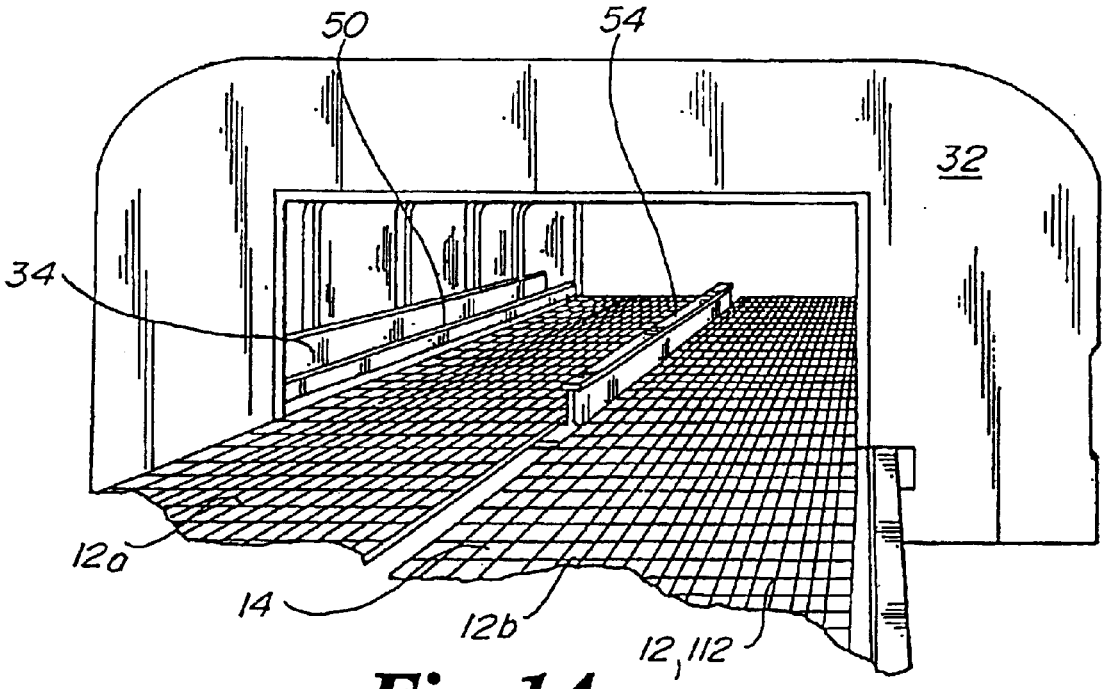
FIG. 14 is a perspective view of a heat tunnel using the embodiment of FIG. 13A.
Figure 15:
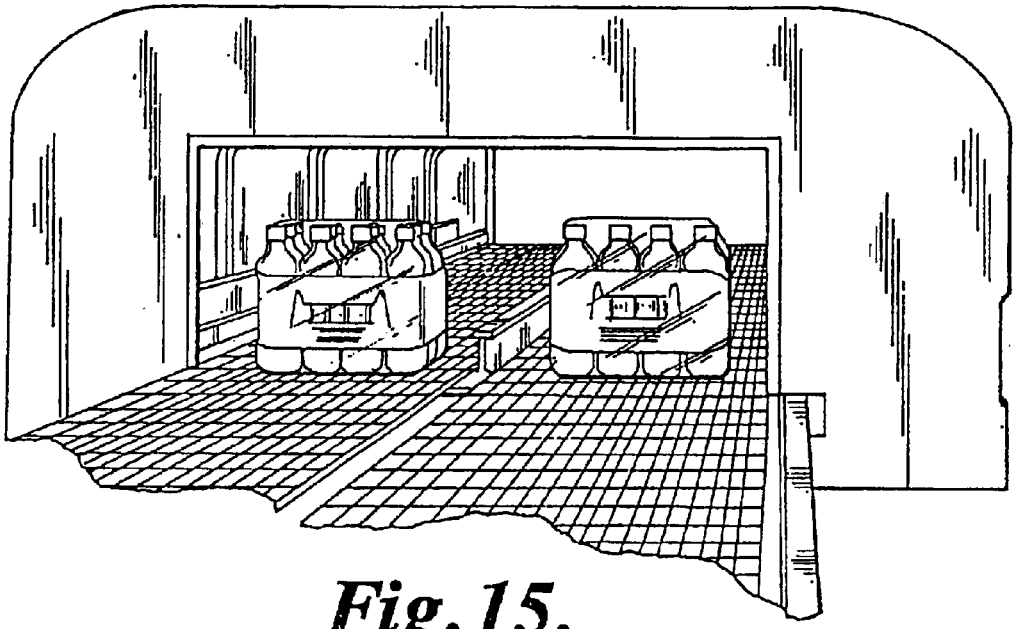
FIG. 15 is similar to FIG. 14, but in addition shows articles being shrink-wrapped within the heat tunnel.

The apparatus 10 further comprises a shroud 32 partially enclosing the conveyor 12 along the first direction and spaced from the conveyor 12 at a displacement. With the conveyor 12, shroud 32 forms a film shrinking area 34 between the conveyor 12 and the shroud 32 (FIG. 14).

Figure 6:
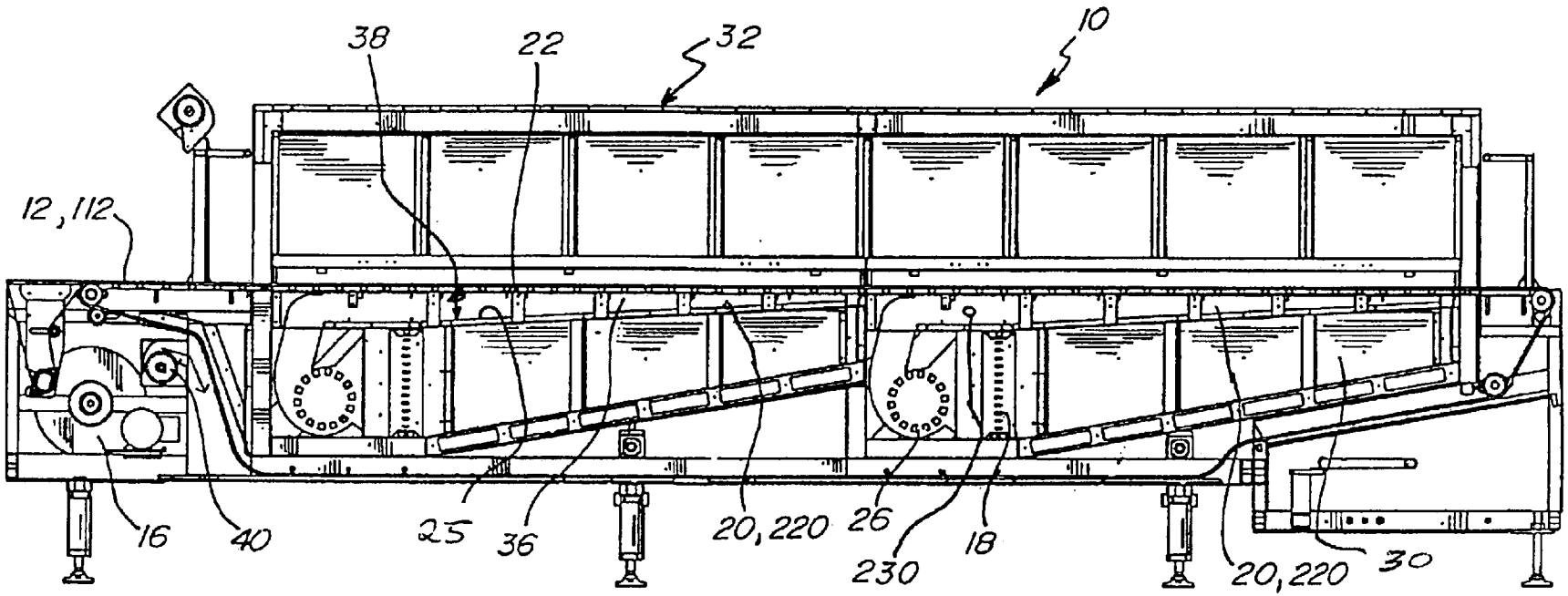
FIG. 6 is a side elevational view of the apparatus of the present invention.
Figure 12:
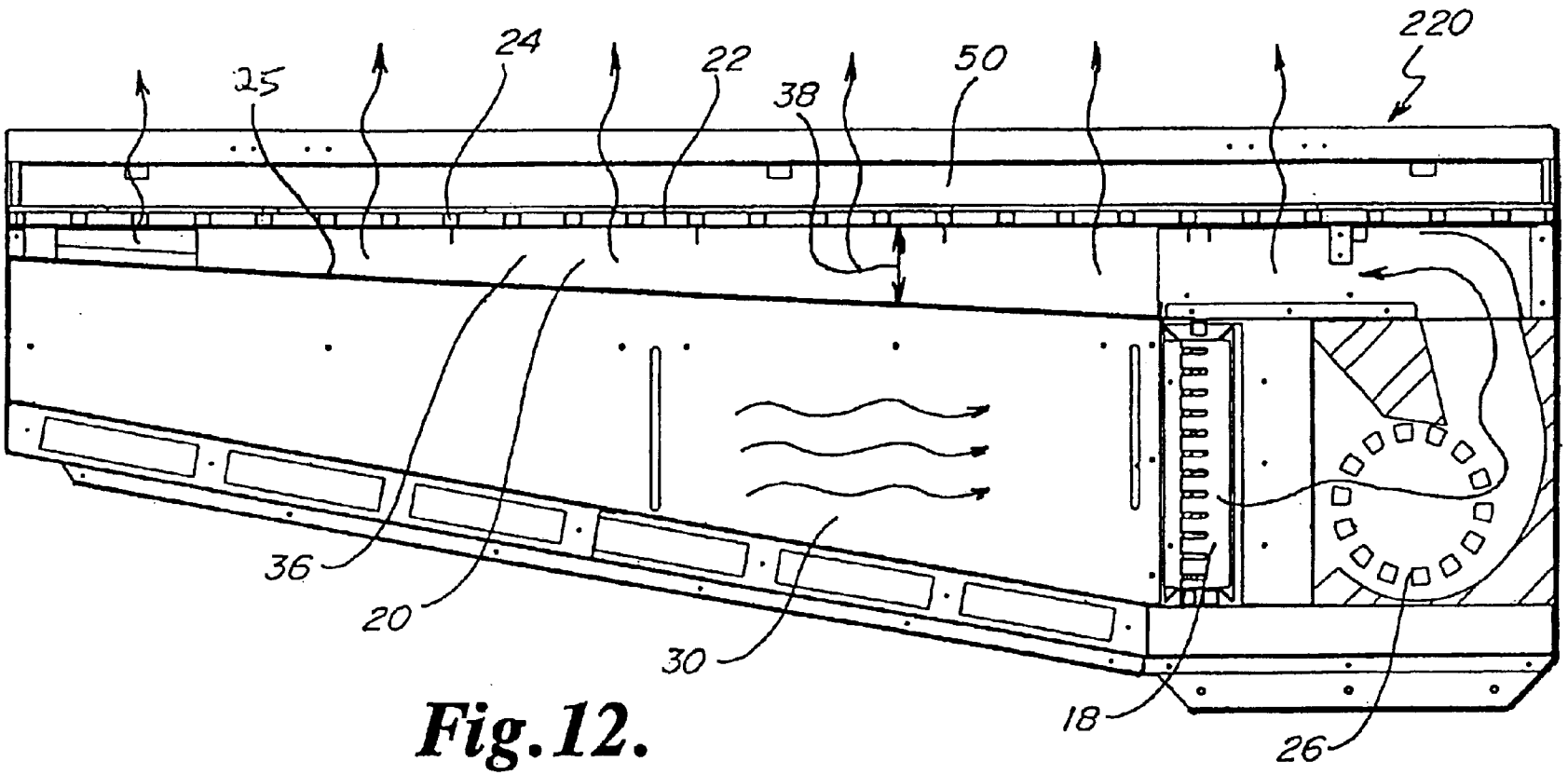
FIG. 12 is a side elevational view of an air supply unit of the present invention.
Figure 13A:
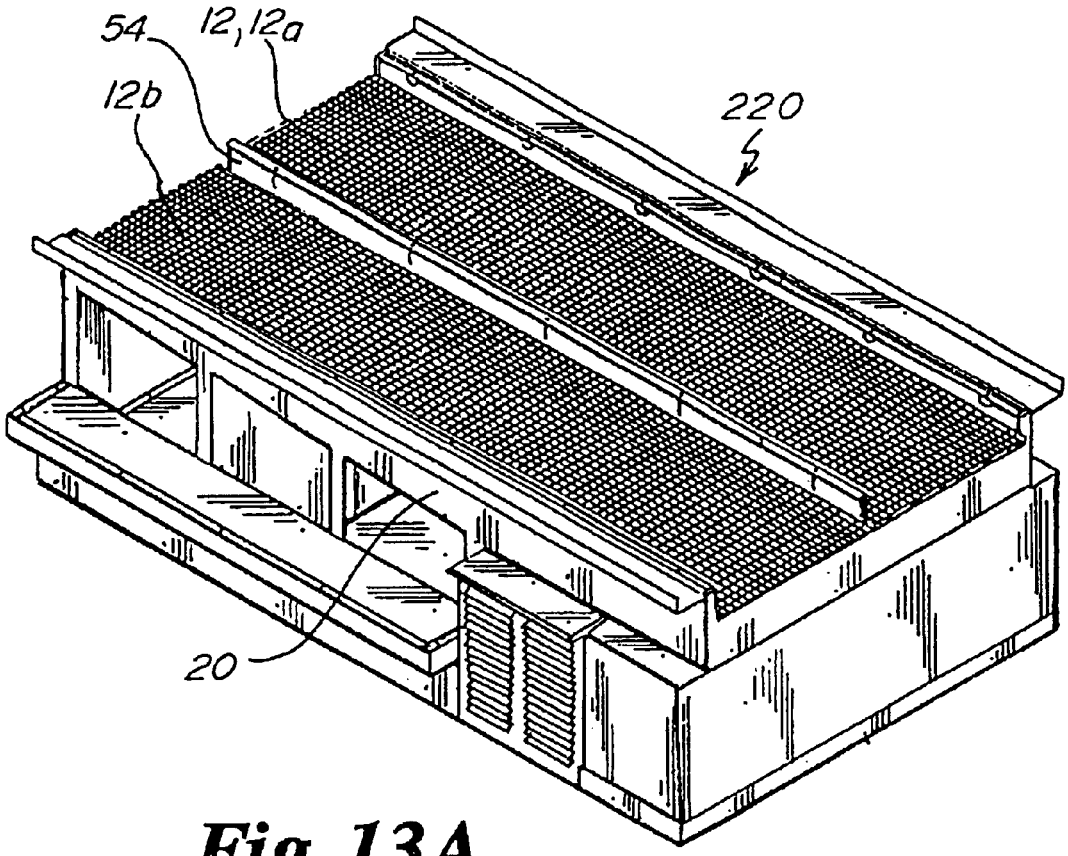
FIG. 13A is a perspective view of a second embodiment of the apparatus of the present invention, with side-by-side conveyor chains.

In one embodiment, the heated air plenum 20 further comprises a bottom surface 25 spaced from and opposing the top surface 22 and forming a duct 36 therebetween. The duct 36 has a height 38, and the height 38 progressively decreases along the first direction, as best seen in FIGS. 6 and 12.

Figure 9:
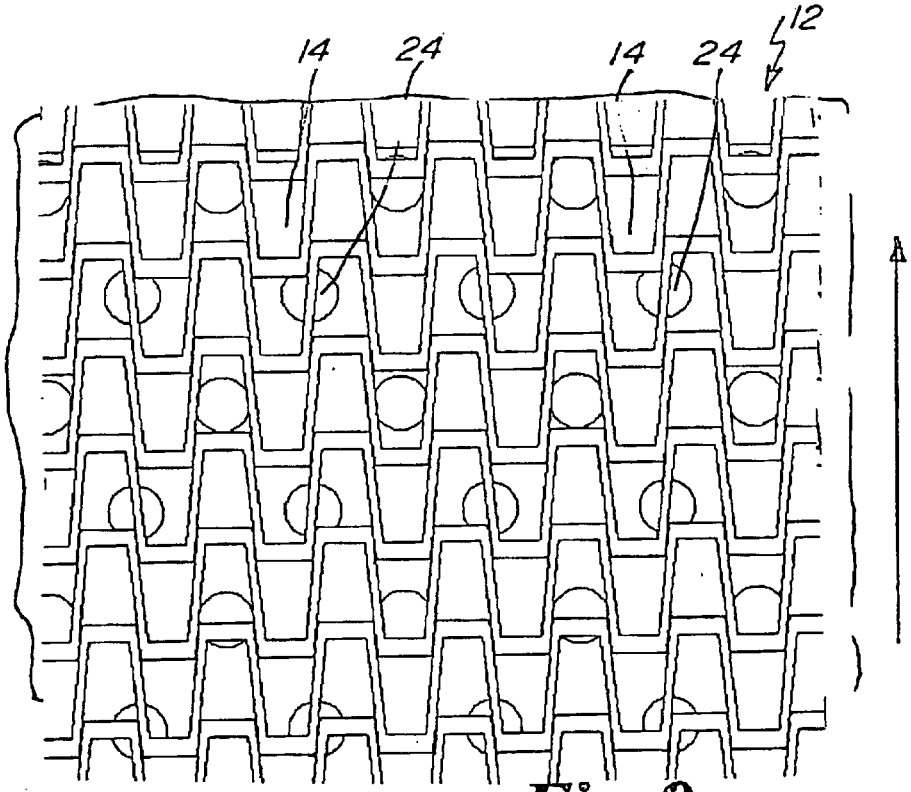
Fig. 9. PRIOR ART
FIG. 9 is a top plan view of a conveyor and heated air plenum of the prior art.

In one embodiment (FIG. 10), the first apertures 14 and second apertures 24 are in substantial alignment as the conveyor 12 moves along the first direction. This structure is significantly different from the prior art (FIG. 9) in which the first apertures and second apertures are substantially unaligned. By having the first apertures 14 and second apertures 24 in substantial alignment, the heated air passing therethrough only heats the conveyor 12 when the two sets of apertures 14, 24 are unaligned. This creates a lower temperature on the conveyor 12, which has important consequences as will be discussed below.

In one embodiment, the apparatus 10 further comprises a conveyor cooling fan 40 which also aids in keeping the temperature of the conveyor 12 significantly lower than in earlier devices.

Figure 11A:
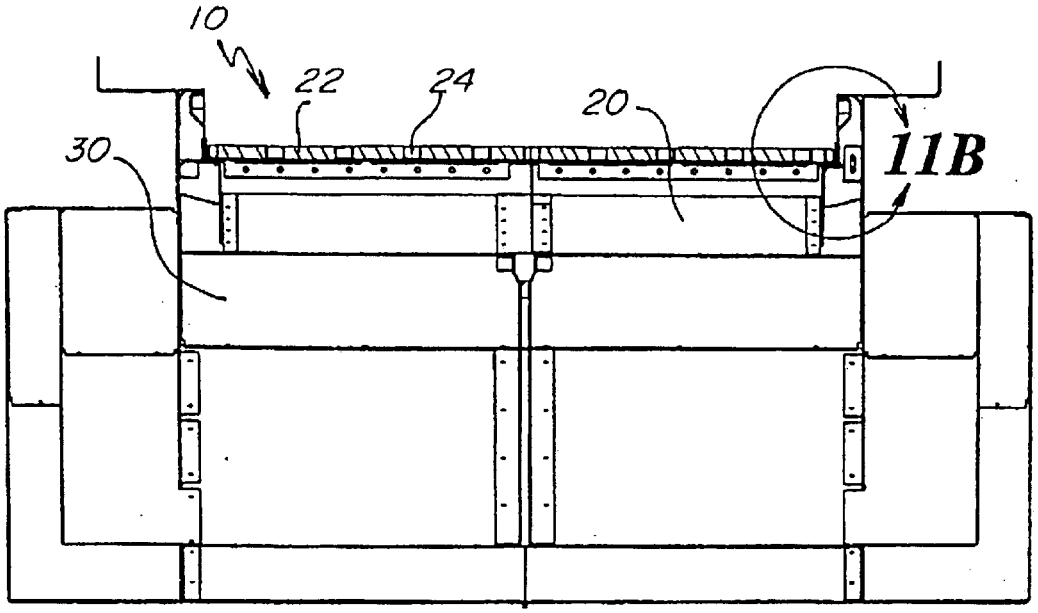
FIG. 11A is a front elevational view of the apparatus of the present invention.
Figure 11B:
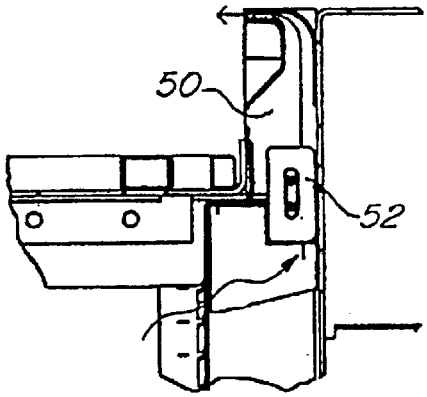
FIG. 11B is a detailed view of the indicated area in FIG. 11A.
Figure 13C:
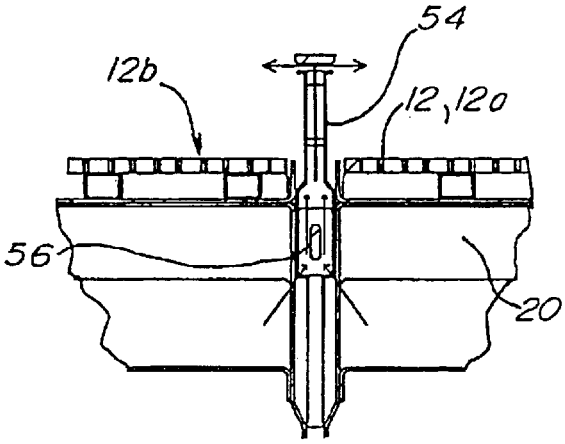
FIG. 13C is a detailed view of the indicated area of FIG. 13B.
Figure 13B:
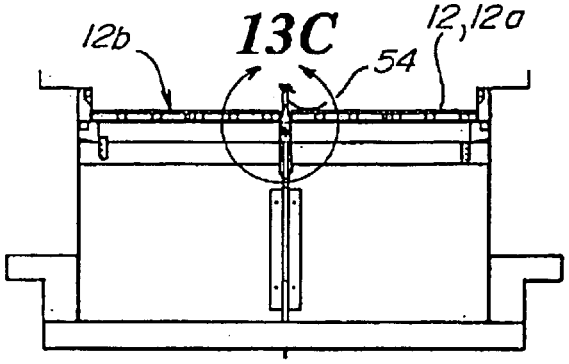
FIG. 13B is a front elevational view of the apparatus of FIG. 13A.

In one embodiment, the apparatus 10 further comprises a side air duct 50 adjacent the conveyor 12 along the first direction, with the side air duct 50 transmitting heated air from the heated air plenum 20. The side air duct 50 may optionally have a supplemental heat source 52 (FIG. 11B), which may be an electrical heater.

In one embodiment (FIGS. 13A–13C, 14, 15), the apparatus 10 further comprises at least two side-by-side conveyor chains 12*a*, 12*b* running along the first direction.

In one embodiment (FIGS. 13A–13C, 14, 15), the apparatus 10 further comprises a center air duct 54 transmitting heated air from the heated air plenum 20. The center air duct 54 may optionally have a supplemental heat source 56, which may be an electrical heater.

In one embodiment (FIG. 5), the displacement 60 at which the shroud 32 is spaced from the conveyor 12 is variable, thereby accommodating articles of various sizes. In such case, the apparatus 10 further comprises a means 62 for varying the displacement 60. The means 62 may either be manual (e.g., a crank or screw) or it may be automatic (e.g., by a motor 62*a*).

In one aspect, the present invention is an apparatus 110 for applying heated air to articles A and to enclose the articles A in shrink-wrap film F.

The apparatus 110 (FIGS. 4, 5, 6, and 10) comprises a moving conveyor 112 having a plurality of first apertures 14 therethrough separated by link bars 15.

The apparatus 110 further comprises a source of heated air 18. The apparatus 110 further comprises (FIG. 7) a heated air plenum 20 under the conveyor 112 and supporting the conveyor chain 112, the plenum 20 having a top surface 22 having a plurality of second apertures 24 therethrough.

In one embodiment (FIG. 10), the first apertures 14 and second apertures 24 are in substantial alignment as the conveyor 112 moves along the first direction. By having the first apertures 14 and second apertures 24 in substantial alignment, the heated air passing therethrough only heats the conveyor 112 when the two sets of apertures 14, 24 are unaligned. This creates a lower temperature on the conveyor 112, which has important consequences as will be discussed below.

In one embodiment, the apparatus 110 further comprises a side air duct 50 adjacent the conveyor 112 along the first direction, with the side air duct 50 transmitting heated air from the heated air plenum 20 transversely across the conveyor 112.

The apparatus 110 further comprises a return air plenum 30 returning air to the source of heated air 18.

The apparatus 110 further comprises a shroud 32 partially enclosing the conveyor 112 and spaced from the conveyor 112. With the conveyor 112, shroud 32 defines a film shrinking area 34 between the conveyor 112 and the shroud 32.

In one embodiment, the heated air plenum 20 is tapered vertically along the conveyor 112 in the direction of movement of the conveyor 112, as best seen in FIGS. 6 and 12.

In one embodiment (FIGS. 13A–13C), the apparatus 110 further comprises at least one additional conveyor chain 12*b*.

In one embodiment (FIGS. 13A–13C, 14, 15), the apparatus 110 further comprises a center air duct 54 between the conveyor chains 12*a*, 12*b* transmitting heated air from the heated air plenum 20 transversely across the conveyor chains 12*a*, 12*b*.

In one aspect, the invention is an apparatus 210 (FIG. 4) for applying heated air to articles A enclosed in shrink-wrap film F. The apparatus 210 includes at least one air supply unit 220, a conveyor 112, and a heat shroud 32 spaced from the conveyor 112, wherein multiple air supply units 220 can be provided along the conveyor 112 to create a heat tunnel of desired length. The air supply unit 220 further comprises a source of heated air 18, a fan 26, a heated air plenum 20, air ducts 50, and a return air plenum 30.

In one embodiment (FIGS. 13A–13C), the apparatus 210 further comprises at least one additional conveyor chain 12*b*.

In one embodiment (FIGS. 13A–13C, 14, 15), the apparatus 210 further comprises a center air duct 54 between the conveyor chains 12*a*, 12*b* transmitting heated air from the heated air plenum 20 transversely across the conveyor chains 12*a*, 12*b*.

In one embodiment (FIG. 5), the displacement 60 between the shroud 32 and the conveyor 112 is variable, thereby accommodating articles of various sizes. In such case, the apparatus 110, 210 further comprises means 62 for lowering and raising the shroud 32 relative to the conveyor chain 112. The means 62 may either be manual (e.g., a crank or screw) or it may be automatic (e.g., by a motor 62*a*).

In one embodiment, the source of heated air 18 is removable from the air supply unit 220.

In one embodiment, the source of heated air 18 is controlled to maintain a constant temperature in the heated air plenum 20.

In one embodiment, the apparatus 210 further comprises a sensor 230 (FIG. 6) in the heated air plenum 20 after the fan 26, with the sensor 230 controlling the temperature of the source of heated air 18.

In one embodiment, the fan 26 has a variable speed to adjust the flow of heated air through the heated air plenum 20.

In one embodiment, the fan 26 is removable from the air supply unit 220.

In one embodiment, the side air duct 50 has an adjustable opening.

In one embodiment, the side air duct 50 has a diffuser 51.

In one aspect, the air supply unit 220 is modular.

Figure 4:
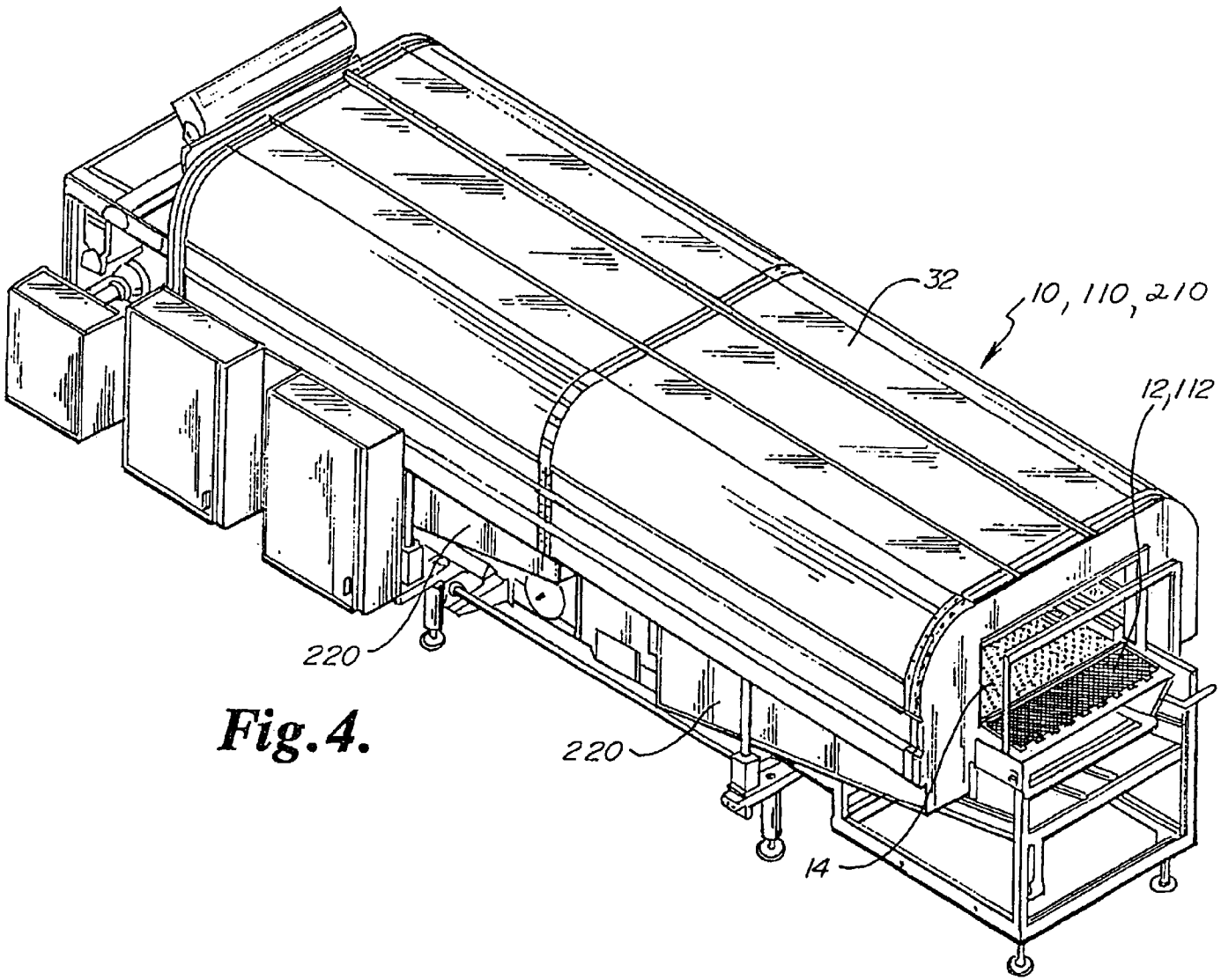
FIG. 4 is a front perspective view of the apparatus of the present invention.
Figure 5:
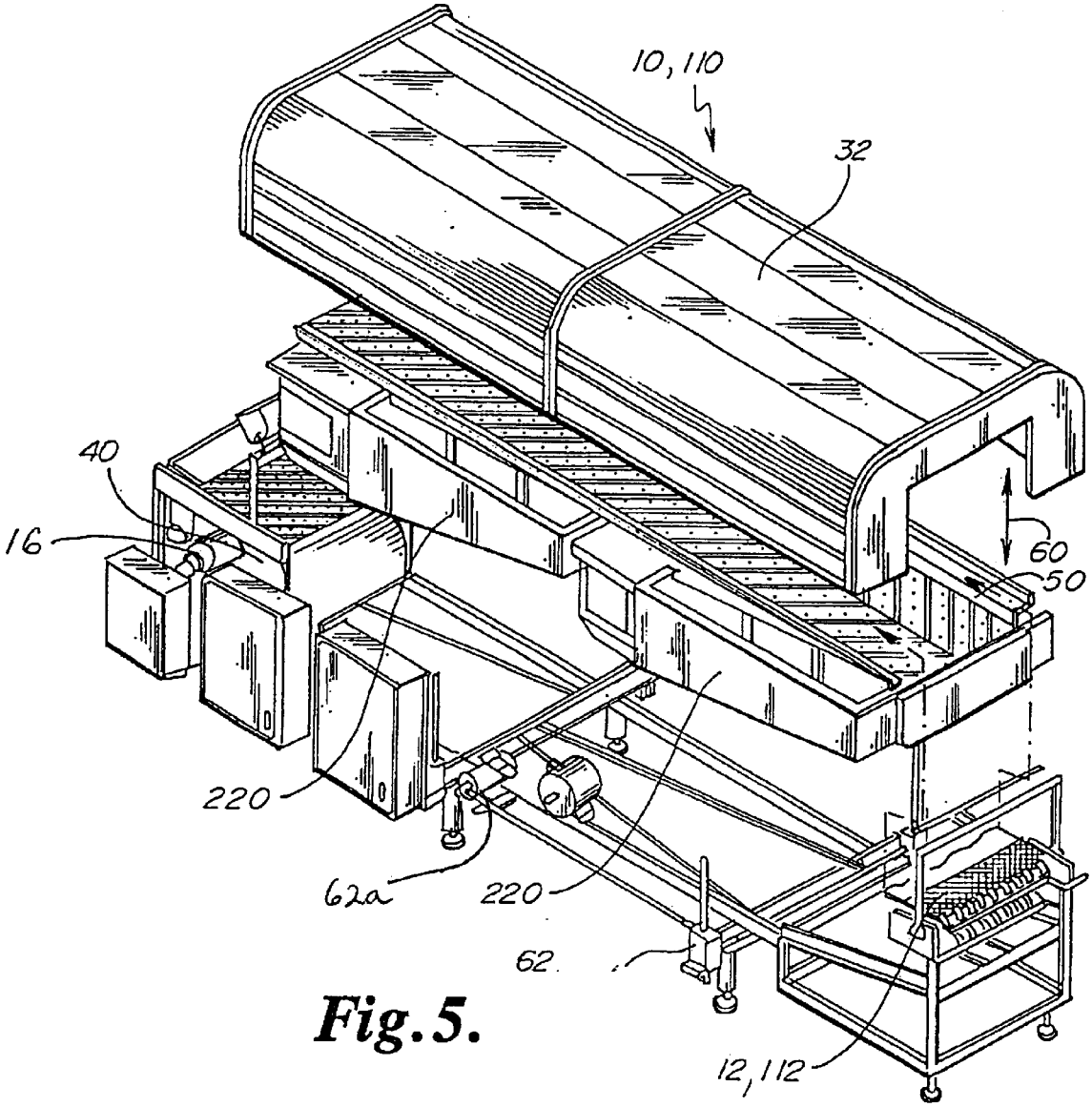
FIG. 5 is an exploded perspective view of the apparatus of the present invention.

In one embodiment, a plurality of the modular air supply units 220 may be serially arranged thereby producing a heat tunnel of variable length, as best seen in FIGS. 4, 5, and 6.

In one embodiment, the heated air plenum 20 is tapered in cross section transversely to the direction of heated air movement with the cross sectional area of the plenum 20 progressively decreasing away from the fan 26 as best seen in FIGS. 6 and 12.

In one embodiment, the modular air supply unit 220 further comprises a retractable center air duct 54 receiving heated air from the heated air plenum 20.

Operation of the invention will now be described in reference to the Figures.

Figure 1:
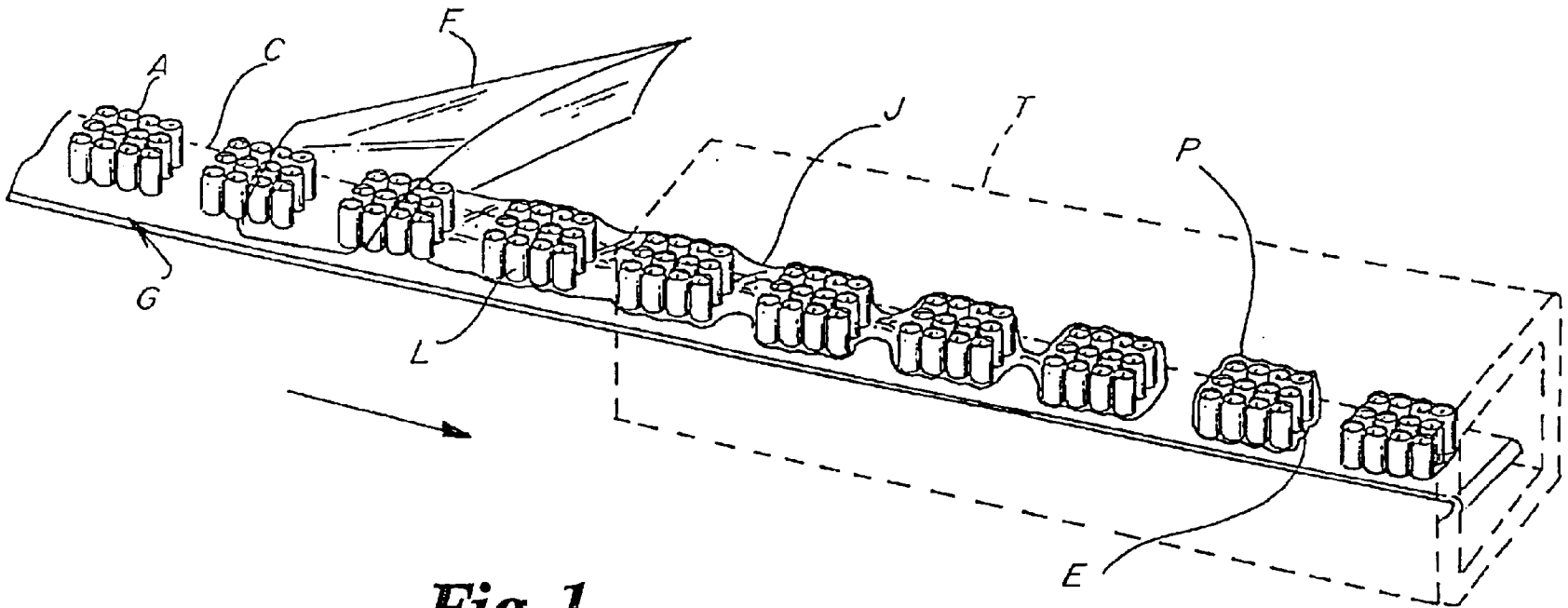
Fig. 1. PRIOR ART
FIG. 1 is a perspective conceptual view of a packaging apparatus of the prior art.
Figure 2:
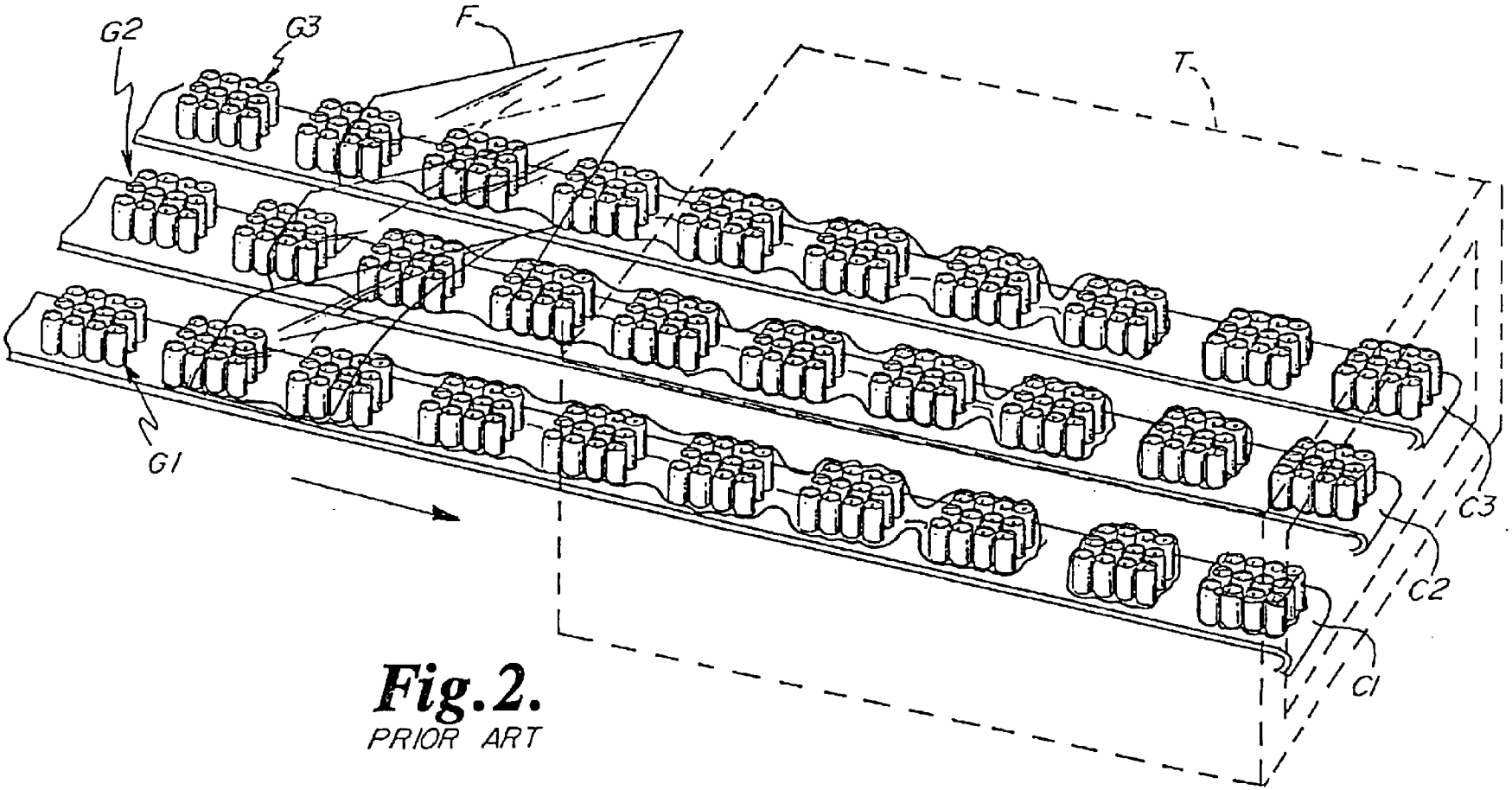
Fig. 2. PRIOR ART
FIG. 2 shows another embodiment of the prior art apparatus of FIG. 1.
Figure 3:
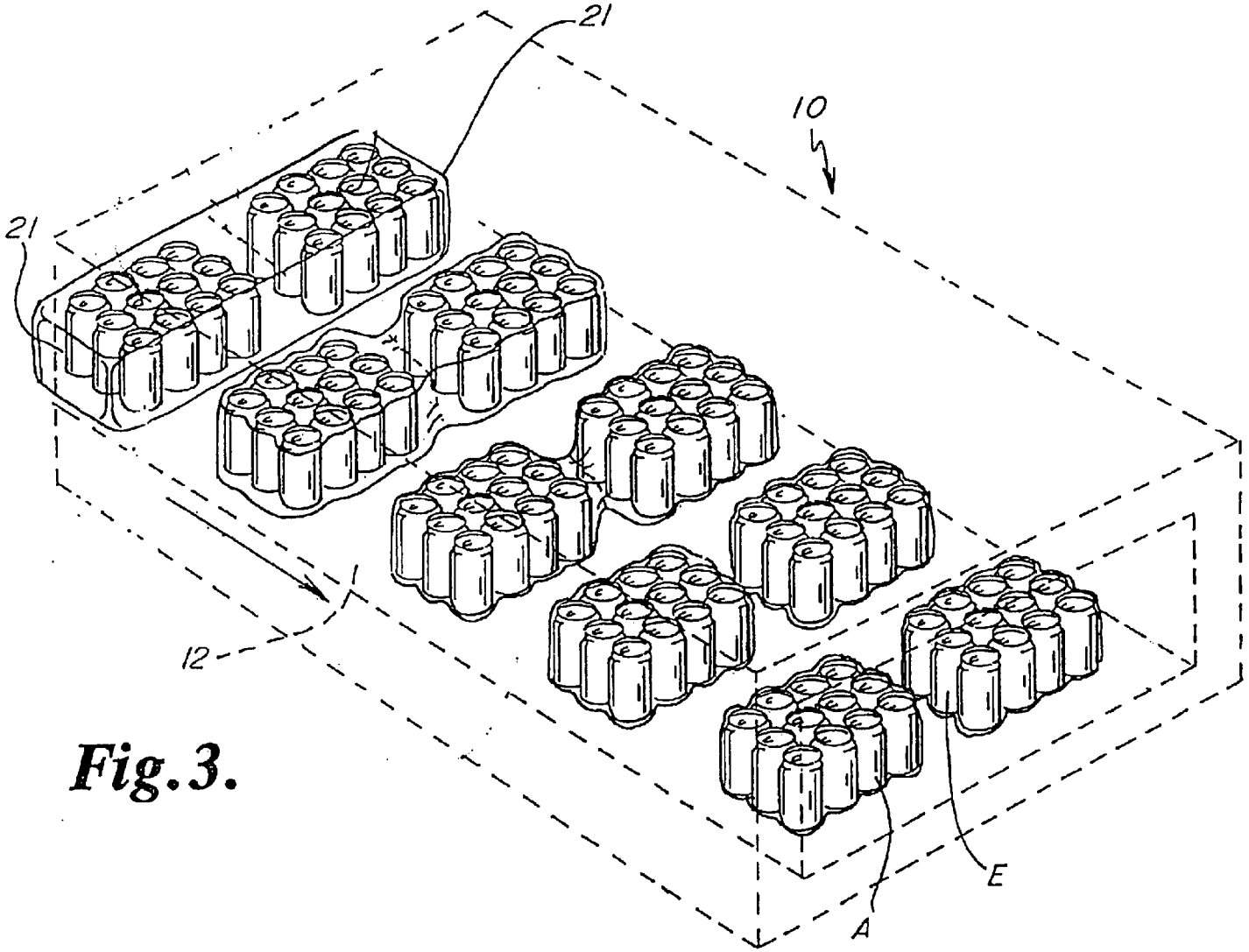
FIG. 3 is a perspective conceptual view of the apparatus of the present invention.

Articles A to be shrink-wrapped are received on an infeed conveyor (not shown) with the shrink-wrap film positioned about the articles A illustratively shown in FIG. 3. Although FIG. 3 shows the articles A enclosed in shrink-wrap film 21 which has been pre-perforated, any type of shrink-wrap film F may be used to enclose the articles A.

Articles A then move from the infeed conveyor to the conveyor 12, 112 as in FIG. 3 and enter the apparatus 10, 110, and 210 shown in FIG. 3.

Figure 10:
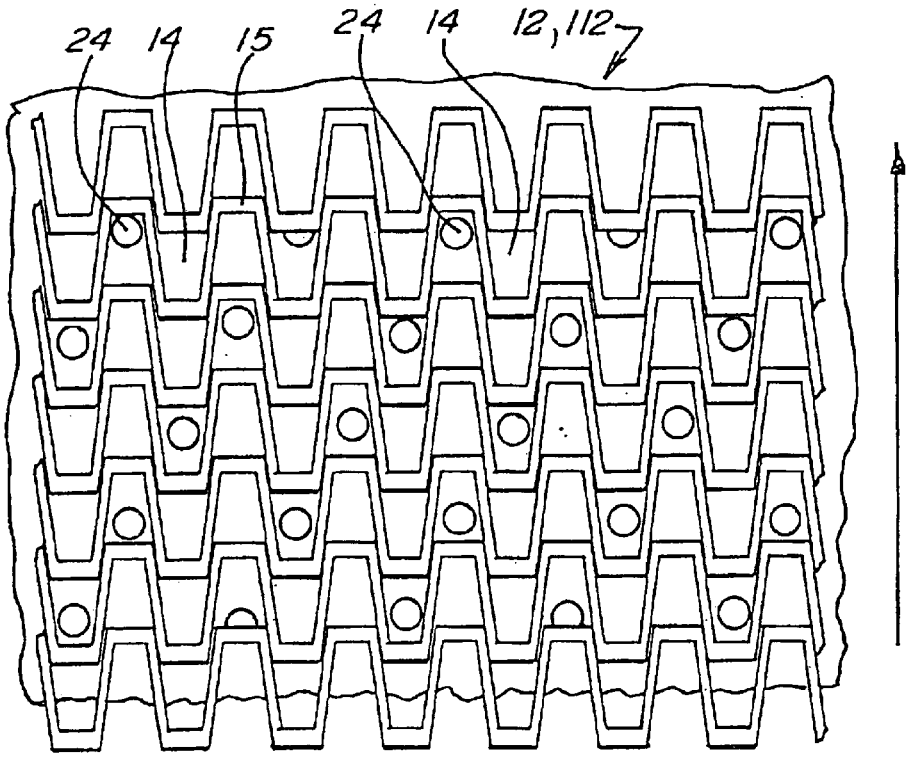
FIG. 10 is a top plan view of a conveyor and heated air plenum of the present invention.

In the case of the various aspects of the present invention, articles A move along the conveyor 12, 112 within the apparatus 10, 110, 210. As they do so, heated air from the source of heated air 18 is driven by the fan 26 along the heated air plenum 20. Heated air then exits the heated air plenum 20 through the second apertures 24. As the conveyor 12, 112 moves along the heated air plenum 20, the first apertures 14, which are in substantial alignment with the second apertures 24, allow heated air to directly contact the shrink-wrap film F under the articles A, producing an air weld. Because the heated air does not contact the conveyor 12, 112 except at the link bars 15 (as shown in FIG. 10), the conveyor 12, 112 remains much cooler than in previous devices. This prevents the shrink-wrap film F from sticking to the conveyor 12, 112. The lower chain temperature also allows the film lap seam under the articles A to be welded by the hot air, rather than by the hot chain which produces an undesirable chain weld. In addition, this prevents the chain itself from robbing heat from the heated air, so that the heated air produces a more efficient air weld on the shrink-wrap film F. Another benefit is that the conveyor 12, 112 has a longer service life. The cooling fan 40 for the conveyor 12, 112 may also be provided to increase these benefits.

As the heated air moves through the heated air plenum 20 away from the fan 26, an amount of air volume is lost out of each of the second apertures 24 in the top surface 22 of the plenum 20. To maintain constant air pressure, the volume of the plenum 20 needs to be reduced accordingly before the next set of apertures 24. The present invention decreases the cross sectional area of the plenum 20 away from the fan 26, thereby adjusting the volume of the plenum 20 in order to keep relatively constant pressure across the length of the plenum 20.

As heated air moves through the second apertures 24 and first apertures 14, the specific size of the second apertures 24 and the alignment with the first apertures 14 produces significantly less turbulence in the heated air, so that a substantially vertical laminar air flow is produced. This in turn causes less fluttering of the shrink-wrap film, resulting in more aesthetically pleasing bulls eyes.

In the case in which the articles are enclosed within shrink-wrap film F such that the open ends of the shrink-wrap film F are oriented transversely across the conveyor 12, 112, the side air ducts 50 provide heated air directed at these openings.

In the case in which the conveyor 12, 112 is split into two side-by-side chains 12*a*, 12*b*, the optional, retractable center air duct 54 is provided to direct heated air at the open ends of the shrink-wrap film F facing the center of the conveyor 12, 112.

Both the side air ducts 50 and the center air duct 54 may be provided with an adjustable opening to adjust the volume of heated air flowing out. In addition, a nozzle or diffuser may be provided to direct the heated air at the articles A.

Utilizing modular air supply units 220 serially arranged to produce a heat tunnel T of variable length, the film shrinking process can be optimally adjusted for the speed of incoming articles A.

Further improvements include the ability to maintain the source of heated air 18 at a constant temperature in the heated air plenum 20. This can be done by providing the sensor 230 (FIG. 6) in the hot air plenum 20, with the sensor 230 controlling the temperature of the source of heated air 18. The speed of the fan 26 may be variable to adjust the flow of heated air through the heated air plenum 20.

A number of serviceability improvements are included in the invention. The source of heated air 18 can be removed from the air supply unit 220 for service and/or replacement, as can the fan 26. In addition, an entire air supply unit 220 can be removed from the heat tunnel and replaced.

Figure 16:
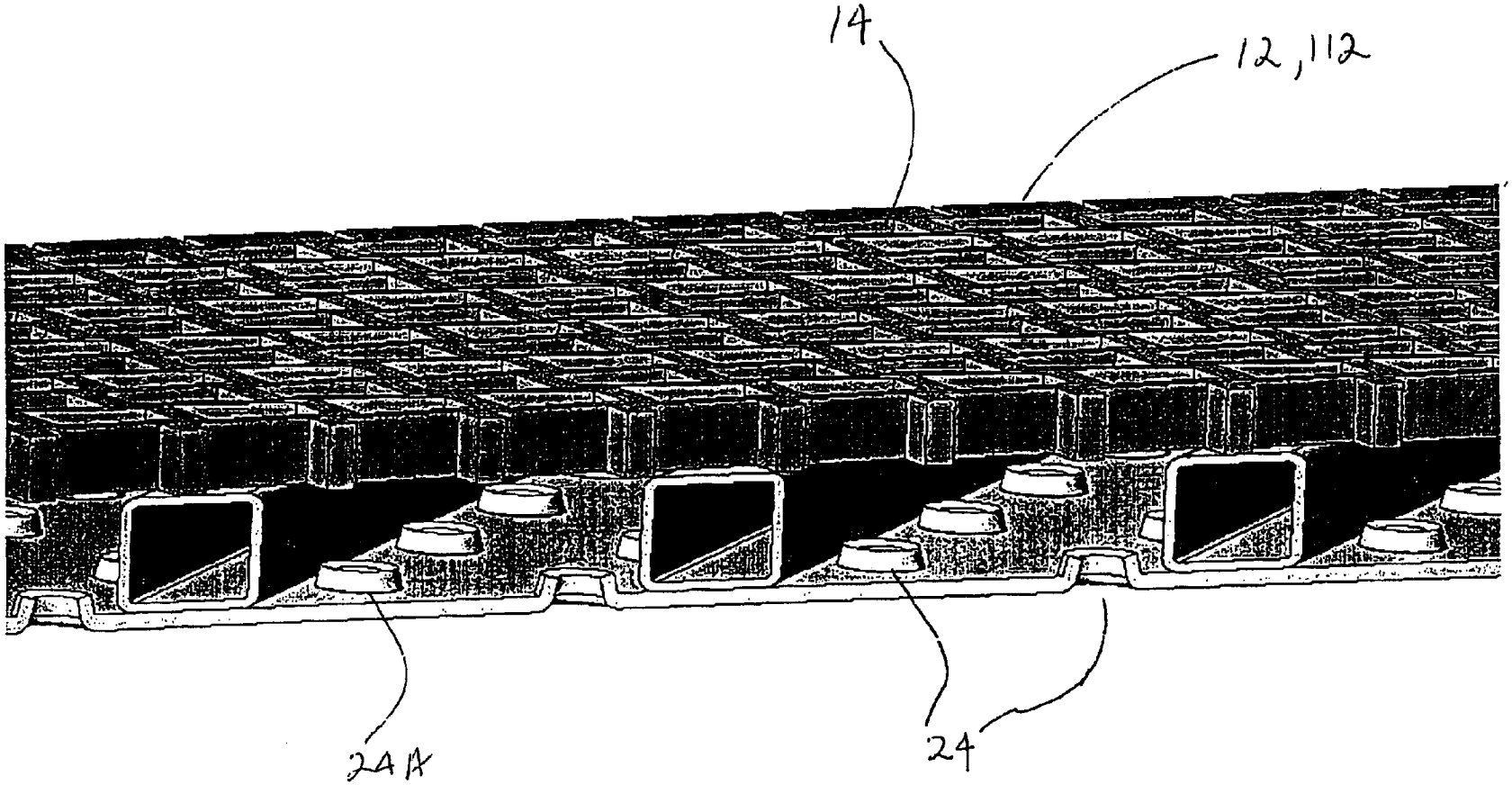
FIG. 16 is a perspective view of the heated air plenum of the present invention showing an embodiment with nozzles about the apertures.
Figure 17:
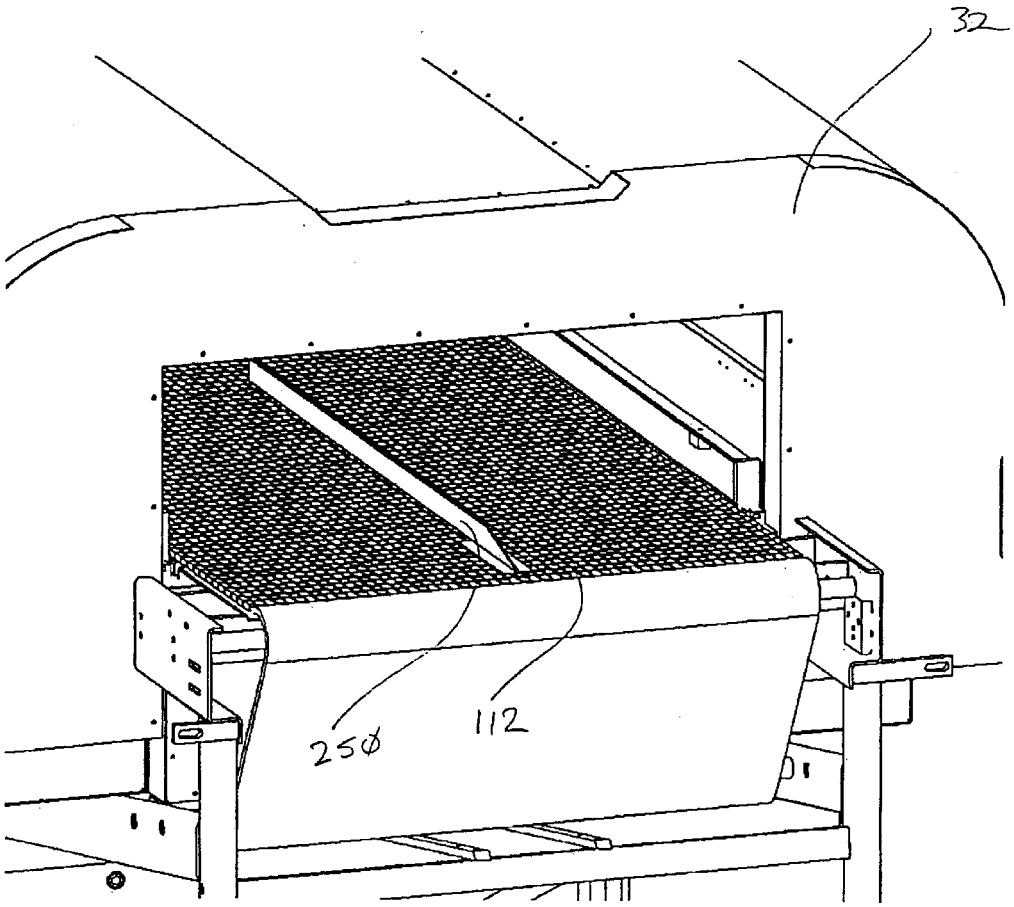
FIGS. 17–20 are perspective views of a heat tunnel of the present invention showing the use of an optional film separator.
Figure 18:
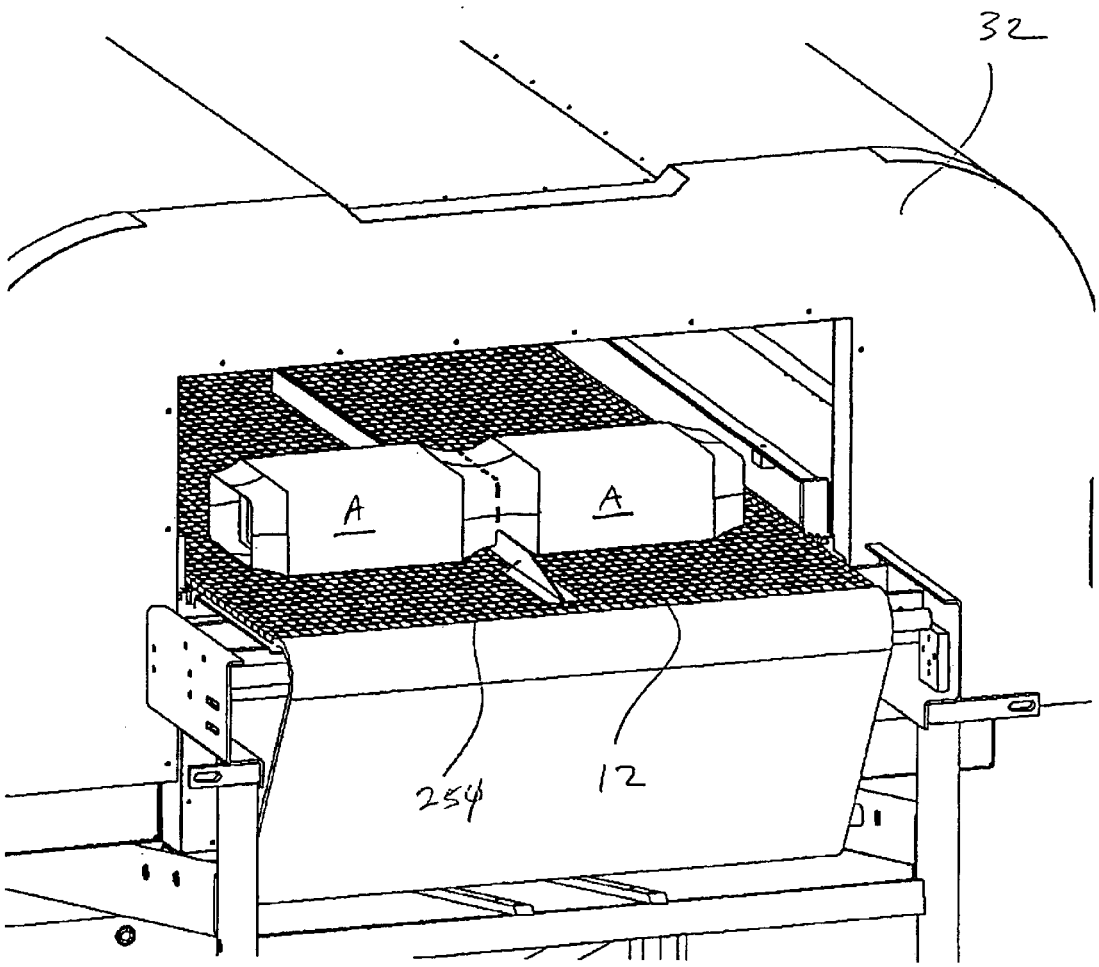

In another embodiment, the second apertures 24 may have small nozzles 24A (FIG. 16). The nozzles 24A increase the length of the aperture 24 and reduce the amount of horizontal air flow that is allowed to exit the aperture 24. The resulting flow from the apertures 24 is thus more vertical, causing less disturbance to the shrink wrap film F.

Figure 19:
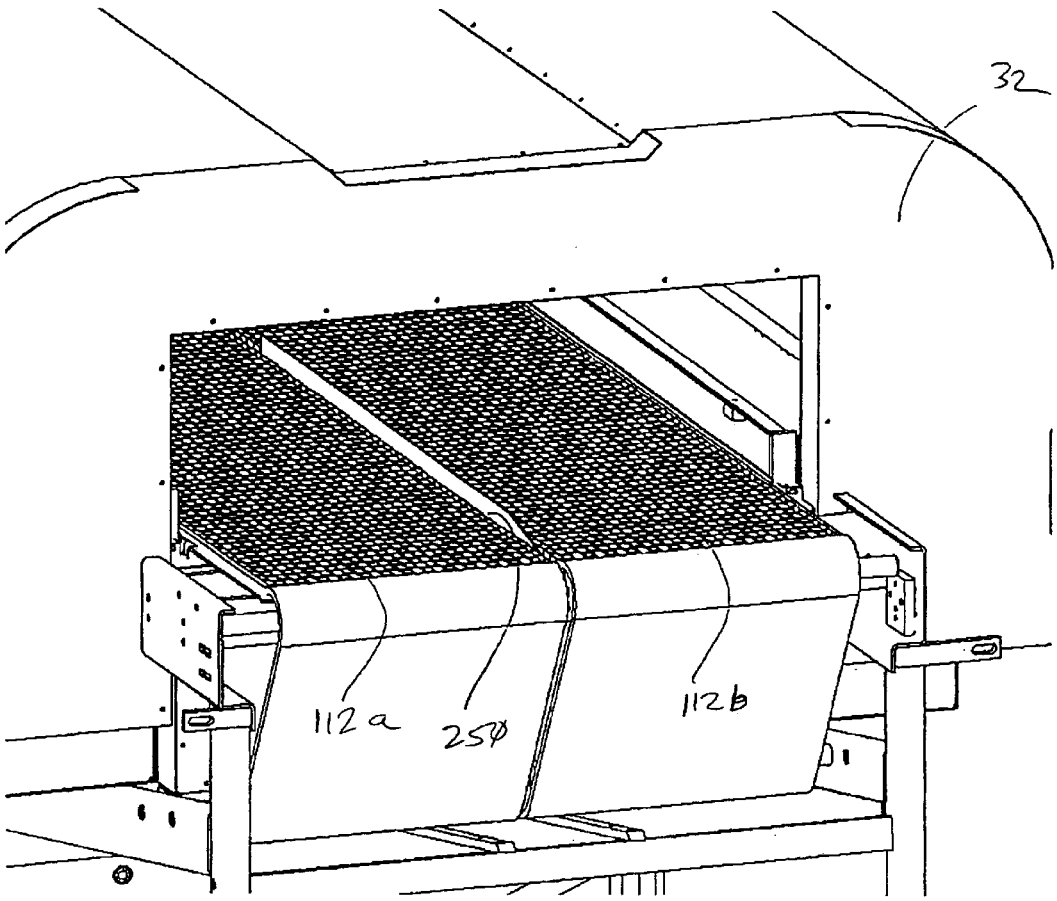
Figure 20:
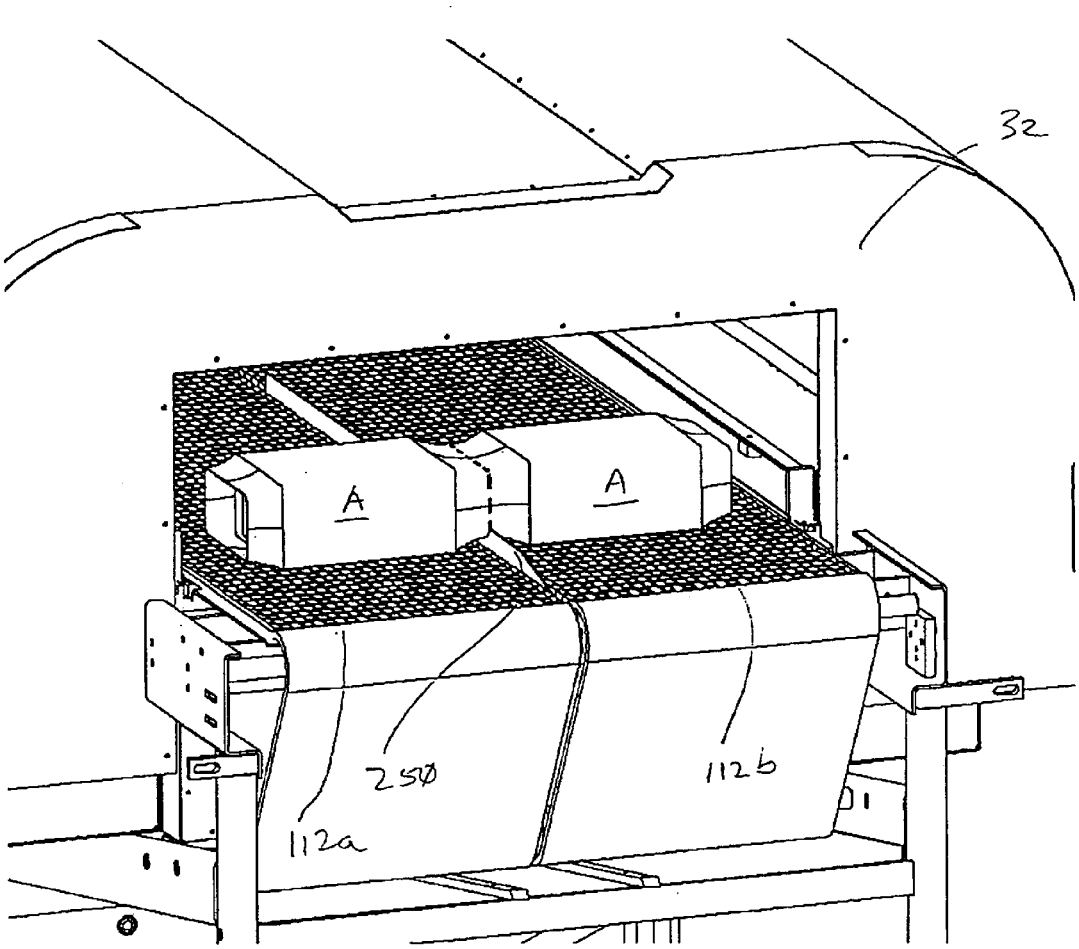

In another embodiment, an optional film separator 250 may be added at the infeed end of the heat tunnel as shown in FIGS. 17–20. The film separator 250 ensures that the film of adjacent packages does not melt and stick together. The film separator 250 extends into the heat tunnel far enough to ensure that the lower portion of the unsupported film, which extends beyond the articles, has started to shrink and draw away from that of the adjacent package. The separator 250 can be mounted on top of the conveyor 12, 112 (FIGS. 17–18) or it may be mounted between a set of conveyor chains 12*a*, 12*b* (FIGS. 19–20).

Figure 21:
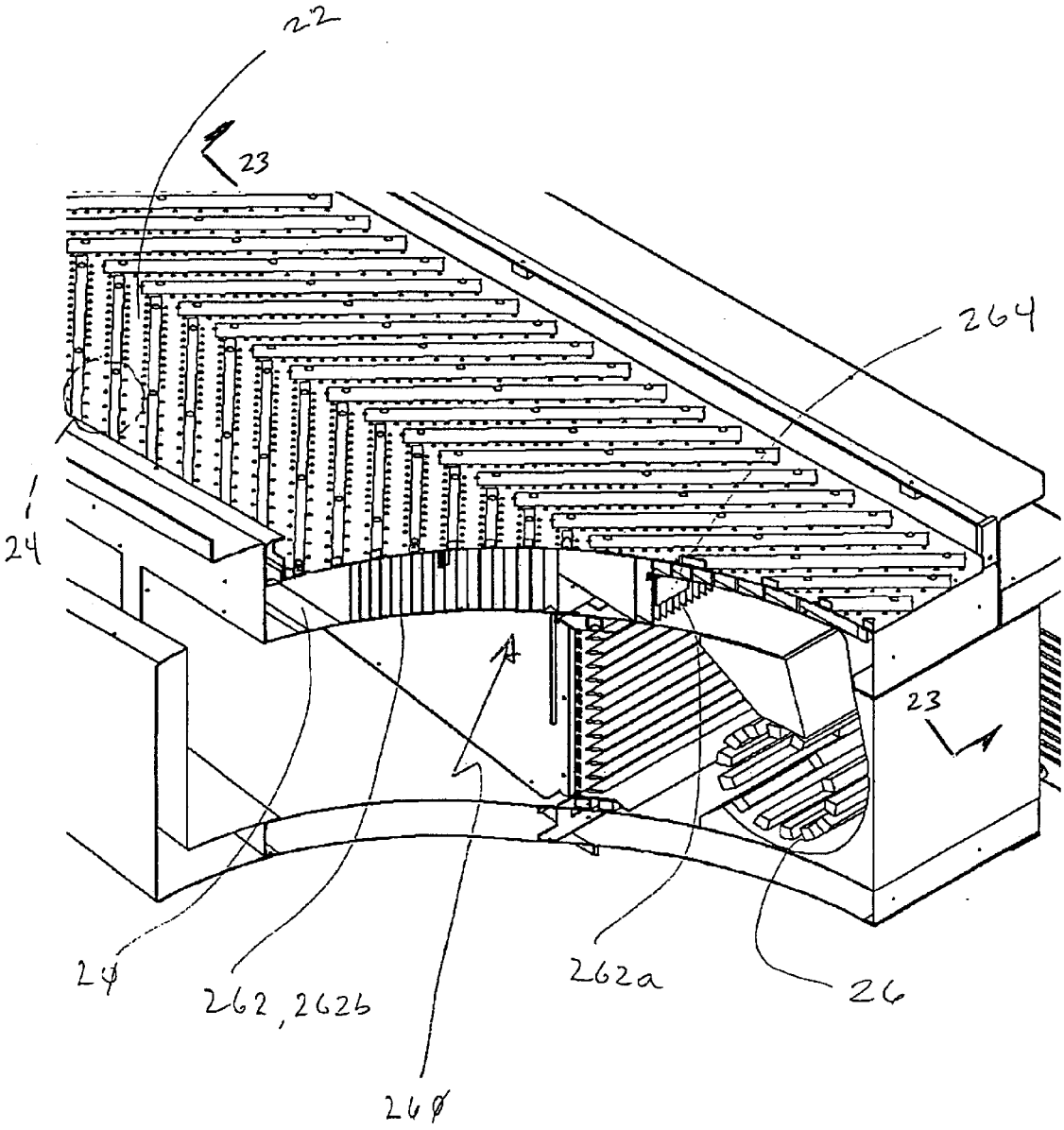
FIG. 21 is a perspective view through the heated air plenum showing another embodiment of the invention with air lanes.
Figure 22:
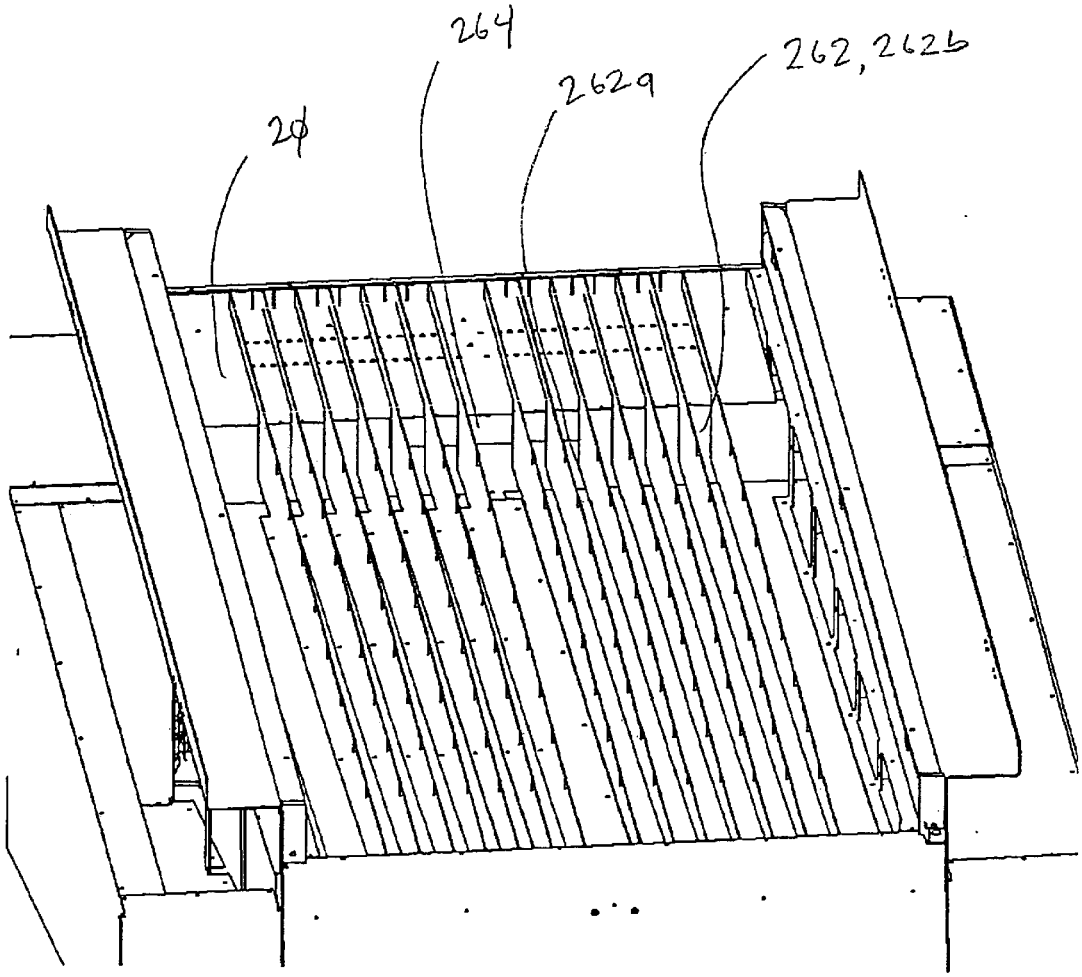
FIG. 22 is a perspective view of the embodiment of FIG. 21.
Figure 23:
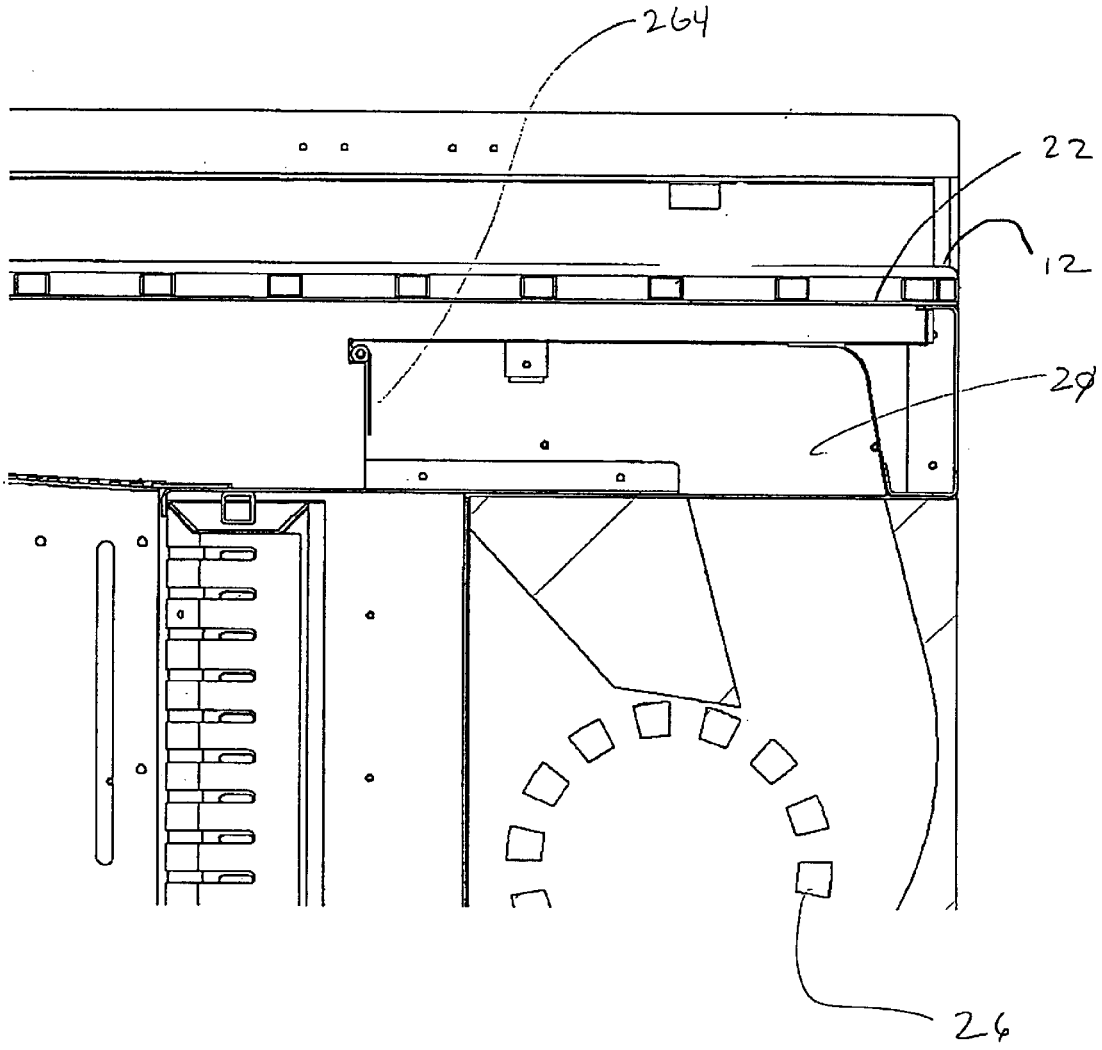
FIG. 23 is a cross-sectional view taken at approximately the lines 23 of FIG. 21.

In another embodiment (FIGS. 21–23), an airflow control mechanism 260 may be added to the heated air plenum 20 to vary the amount of heated air sent through the second apertures 24 across the width of the plenum 20. It has been found that, in the case of perforated film, the amount of airflow required to separate the film at the perforation may be too much for the bottom of the package. This may cause excessive shrink and create holes in the film. The airflow control mechanism 260 preferably comprises air lanes 262 in the heated air plenum 20 under the conveyor 12, 112. These air lanes 262 will provide heated air to one or more columns of the second apertures 24 across the width of the plenum 20. Furthermore, the amount of air supplied to each air lane 262 may be independently adjustable through the use of one or more baffles 264. In the usual case, the air lanes 262*a* under the weakened film and on either side of the outer packages will be open to allow maximum energy through the conveyor 12 in order to separate the packages and shrink the film. However, the lanes 262*b* directly underneath the packages will be restricted so that the lap seam on the bottom of the package is still welded, but the film is not damaged due to excessive heat. It should be understood that the drawings represent one example of the use of air lanes, and that other baffle configurations are contemplated to be within the scope of the invention.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed:

1. Apparatus for applying heat to articles enclosed in shrink-wrap film, the apparatus comprising:

(a) a conveyor having a plurality of first apertures therethrough;

(b) wherein the conveyor moves in a first direction;

(c) a source of heated air;

(d) a heated air plenum under the conveyor and supporting the conveyor, the plenum having a top surface having a plurality of second apertures therethrough;

(e) a fan blowing heated air from the source of heated air through the heated air plenum, through the second apertures, and through the first apertures;

(f) a return air plenum returning air to the source of heated air;

(g) a shroud partially enclosing the conveyor along the first direction and spaced therefrom at a displacement, forming therewith a film shrinking area between the conveyor and the shroud; and (h) an air flow control mechanism controlling the volume of heated air passing through the second apertures, the air flow control mechanism further comprising one or more air lanes in the heated air plenum, the air lanes directing the air flow only at specific, designated portions of the article; and (i) wherein each of the air lanes are open and extend substantially parallel to the first direction for a major length of said heated air plenum.

2. The apparatus of claim 1, wherein the heated air plenum further comprises a bottom surface spaced from and opposing the top surface and forming a duct therebetween, the duct having a height, the height progressively decreasing along the first direction.

3. The apparatus of claim 1, wherein the first apertures and the second apertures are in substantial alignment as the conveyor moves along the first direction.

4. The apparatus of claim 1, further comprising a conveyor cooling fan.

5. The apparatus of claim 1, further comprising a side air duct adjacent the conveyor along the first direction, the side air duct transmitting heated air from the heated air plenum.

6. The apparatus of claim 5, further comprising a supplemental heat source for the side air duct.

7. The apparatus of claim 1, wherein the conveyor further comprises at least two side-by-side conveyor chains running along the first direction.

8. The apparatus of claim 7, further comprising a center air duct between the two side-by-side conveyor chains, the center air duct transmitting heated air from the heated air plenum.

9. The apparatus of claim 8, further comprising a supplemental heat source for the center air duct.

10. The apparatus of claim 1, wherein the displacement is variable, thereby accomodating articles of different sizes.

11. The apparatus of claim 10, further comprising means for varying the displacement.

12. The apparatus of claim 11, wherein the means for varying the displacement is manual.

13. The apparatus of claim 11, wherein the means for varying the displacement is automatic.

14. The apparatus of claim 1, wherein the second apertures are about 7/16 inch to 7/32 inch in size, thereby resulting in substantially vertical laminar air flow through the second apertures.

15. The apparatus of claim 8, wherein the air flow from the center air duct is adjustable.

16. The apparatus of claim 8, wherein the air flow from the center air duct is diffused.

17. The apparatus of claim 1, wherein the second apertures further comprise nozzles.

18. The apparatus of claim 1, further comprising a film separator on the conveyor.

19. The apparatus of claim 7, further comprising a film separator between the two side-by-side conveyor chains.

20. The apparatus of claim 2, further comprising one or more baffles selectively blocking air flow across the one or more air lanes.

21. The apparatus of claim 1, further comprising one or more fixed baffles selectively blocking air flow across the one or more air lanes.

* * * * *